US009719251B2

(12) United States Patent
Gosling

(10) Patent No.: US 9,719,251 B2
(45) Date of Patent: Aug. 1, 2017

(54) MODULAR IN-WALL FUNCTIONAL CONDUITS

(71) Applicant: DIRTT ENVIRONMENTAL SOLUTIONS, LTD., Calgary (CA)

(72) Inventor: Geoff Gosling, Calgary (CA)

(73) Assignee: DIRTT Environmental Solutions, LTD., Calgary (CA)

( * ) Notice: Subject to any disclaimer, the term of this patent is extended or adjusted under 35 U.S.C. 154(b) by 0 days.

(21) Appl. No.: 14/003,287

(22) PCT Filed: Feb. 28, 2013

(86) PCT No.: PCT/US2013/028404
§ 371 (c)(1),
(2) Date: Sep. 5, 2013

(87) PCT Pub. No.: WO2013/130871
PCT Pub. Date: Sep. 6, 2013

(65) Prior Publication Data

US 2015/0143763 A1 May 28, 2015

Related U.S. Application Data

(60) Provisional application No. 61/605,061, filed on Feb. 29, 2012.

(51) Int. Cl.
*E04B 2/28* (2006.01)
*E04B 2/14* (2006.01)
(Continued)

(52) U.S. Cl.
CPC ..... *E04B 2/7407* (2013.01); *E04B 1/34326* (2013.01); *E04B 1/34384* (2013.01);
(Continued)

(58) Field of Classification Search
CPC . E04C 1/39; E04C 1/392; E04C 1/397; E04B 2/14; E04B 2/28; E04B 5/48;
(Continued)

(56) References Cited

U.S. PATENT DOCUMENTS 1,863,981 A * 6/1932 Groves ..... 52/274
2,182,422 A * 12/1939 Bond ..... 454/306
(Continued)

FOREIGN PATENT DOCUMENTS

EP 1538272 6/2005
JP 0528782 11/1993
(Continued)

OTHER PUBLICATIONS

International Search Report and Written Opinion for PCT/US2013/028404 mailed Feb. 28, 2013.
European Search Report for EP13754328 dated Sep. 29, 2015.

*Primary Examiner* — Phi A
(74) *Attorney, Agent, or Firm* — Workman Nydegger

(57) ABSTRACT

Implementations of the present invention relate to systems, methods, and apparatus for delivering and/or removing fluid from a discrete location within a building. In particular, the present invention involves a modular conduit system that can supply or remove air, water, gas, or other fluids to/from an individual space created by modular walls.

20 Claims, 7 Drawing Sheets

(51) Int. Cl.

| | |
|---|---|
| ***E04C 1/39*** | (2006.01) |
| ***E04B 2/74*** | (2006.01) |
| ***F24F 13/02*** | (2006.01) |
| ***E04B 1/343*** | (2006.01) |
| *E04C 3/04* | (2006.01) |

(52) U.S. Cl.
CPC ..... *E04B 2/7448* (2013.01); *F24F 13/0227* (2013.01); *E04B 2/14* (2013.01); *E04B 2002/7461* (2013.01); *E04B 2002/7462* (2013.01); *E04B 2002/7488* (2013.01); *E04C 1/39* (2013.01); *E04C 2003/0452* (2013.01)

(58) Field of Classification Search
CPC .. E04B 2/7407; E04B 1/34326; E04B 1/4384; E04B 2002/7461
USPC ..... 52/302.1, 302.3, 302.5, 239, 241, 243, 52/243.1, 270, 745.05, 745.15, 745.19, 52/220.5, 220.8, 220.7, 220.2, 220.1, 219
See application file for complete search history.

(56) References Cited

U.S. PATENT DOCUMENTS

| | | | | | |
|---|---|---|---|---|---|
| 2,781,657 | A * | 2/1957 | Taylor | E04B 2/14 | 52/220.2 |
| 2,822,898 | A | 2/1958 | Richards | | |
| 2,849,942 | A * | 9/1958 | Goemann | 454/185 | |
| 3,694,973 | A * | 10/1972 | Unger | E04C 2/521 | 52/125.4 |
| 3,771,273 | A * | 11/1973 | Brodie | E04B 1/24 | 165/168 |
| 4,007,574 | A * | 2/1977 | Riddell | 52/302.3 | |
| 4,353,411 | A * | 10/1982 | Harter | F24F 7/04 | 165/129 |
| 4,365,590 | A * | 12/1982 | Ruggieri et al. | 119/418 | |
| 4,457,116 | A * | 7/1984 | Kump | E03C 1/01 | 52/220.2 |
| 4,905,428 | A * | 3/1990 | Sykes | E04B 2/7425 | 160/135 |
| 5,175,969 | A * | 1/1993 | Knauf | E04B 2/7422 | 160/135 |
| 5,761,864 | A * | 6/1998 | Nonoshita | 52/302.3 | |
| 5,953,871 | A | 9/1999 | Macconnell | | |
| 8,033,065 | B2 * | 10/2011 | Paetkau et al. | 52/220.1 | |
| 8,490,352 | B2 * | 7/2013 | Trimmer | E04B 1/16 | 52/220.1 |
| 2002/0104271 | A1 | 8/2002 | Gallant | | |
| 2002/0124495 | A1 * | 9/2002 | Layne et al. | 52/220.1 | |
| 2006/0059806 | A1 | 3/2006 | Gosling | | |
| 2007/0084139 | A1 * | 4/2007 | Stender | 52/302.1 | |
| 2009/0094911 | A1 * | 4/2009 | Whitaker | H02G 3/126 | 52/220.2 |
| 2011/0173909 | A1 * | 7/2011 | Viau et al. | 52/302.1 | |
| 2011/0277405 | A1 * | 11/2011 | Bowron | 52/302.1 | |

FOREIGN PATENT DOCUMENTS

| | | |
|---|---|---|
| JP | 08042910 | 2/1996 |
| JP | 09041556 | 2/1997 |
| KR | 2020110011967 | 12/2011 |
| LU | 85045 | 3/1984 |

* cited by examiner

MODULAR IN-WALL FUNCTIONAL CONDUITS

CROSS-REFERENCE TO RELATED APPLICATIONS

The present application is a 35 U.S.C. §371 U.S. National Stage of PCT Patent Application No. PCT/US2013/028404 filed Feb. 28, 2013, entitled "Modular In-Wall Functional Conduits," which claims benefit to U.S. Provisional Patent Application No. 61/605,061, filed Feb. 29, 2012, entitled "MODULAR IN-WALL FUNCTIONAL CONDUITS," the entire content of which are incorporated herein by this reference.

BACKGROUND OF THE INVENTION

1. The Field of the Invention

This invention relates to systems, methods, and apparatus for providing modular and/or local conduits capable of fluid delivery and extraction.

2. Background and Relevant Art

Office space can be relatively expensive due to the basic costs of the location and size of the office space. In addition to these costs, an organization may incur further expense configuring the office space in a desirable layout. An organization might purchase or rent a large open space in a building, and then subdivide or partition the open space into various offices, conference rooms, or cubicles. Rather than having to find new office space and move as an organization's needs change, it is often desirable to reconfigure the existing office space. Many organizations address their configuration and reconfiguration issues by dividing large, open office spaces into individual work areas using modular wall segments and partitions.

In particular, at least one advantage of modular systems is that they are relatively easy to configure. In addition, modular systems can be less expensive to set up and can allow for reconfiguration more easily than more permanently constructed office dividers. For example, a set of offices and a conference area can be carved out of a larger space in a relatively short period of time with the use of modular systems. If office space needs change, the organization can readily reconfigure the space.

In general, modular office partitions typically include a series of individual wall modules (and/or panels). The individual wall modules are typically free-standing or rigidly attached to one or more support structures. In addition, the wall modules are typically designed to provide a wide variety of potential configurations. In particular, a manufacturer or assembler can usually align and join the various wall modules together in almost any particular design. These designs can include anything from large conference spaces to individual offices.

One will appreciate, however, that positioning of such partitions and, consequently, individual spaces (e.g., offices, conference rooms, etc.) oftentimes cannot coincide with existing fluid distribution systems (e.g., HVAC, plumbing, gas, etc.) within the building. Moreover, at times, occupants may desire to reconfigure individual spaces, making alignment of such spaces with the building's conduit more challenging and sometimes impossible. Reconfiguring the building's existing fluid distribution systems can present another substantial challenge, which can result in prohibitive cost associated with such reconfiguration. Conventional modular wall and partition systems do not provide any fluid delivery or removal options for individual spaces. Consequently, typical occupants or users of individual spaces have little, if any, control over their environment, including temperature, humidity, air circulation, and air quality within as well as fluid delivery to the individual spaces.

Accordingly, there are a number of disadvantages in conventional modular partitioning systems that can be addressed.

BRIEF SUMMARY OF THE INVENTION

Implementations of the present invention provide systems, methods, and apparatus for delivering and/or removing fluid from a discrete location within a building. In particular, at least one implementation includes a modular conduit system that can supply or remove air, water, gas, or other fluids to/from an individual space created by modular walls. For example, a functional wall module can include one or more modular conduit systems. The modular conduit system within a modular wall (i.e., a wall comprising of one or more wall modules) can channel the fluid into and/or out of an individual space. Hence, a builder or installer can position such wall modules in a manner that permits users or occupants of the building to control temperature, humidity, air circulation, and air quality, etc. within the individual spaces in the building.

At least one implementation includes a functional wall module for at least partially forming an individual space and for providing fluids into the individual space or for removing fluids therefrom. The functional wall module has one or more vertical supports and one or more horizontal supports secured to at least one of the one or more vertical supports. Additionally, the functional wall module has a modular conduit system coupled to at least one of the one or more vertical support and the one or more horizontal supports. The modular conduit system includes a modular conduit sized and configured for one or more of delivering fluids to the individual space and extracting fluids from the individual space. Furthermore, the modular conduit include one or more vertical conduit supports coupled to and at least partially supporting the modular conduit, the one or more vertical conduit supports further being coupled to at least one of the one or more vertical supports and one or more horizontal supports.

Additional or alternative implementations include a modular wall installation for creating an individual space that has fluid delivery thereto and/or fluid removal therefrom. The modular wall installation incorporates one or more wall modules selectively and detachably coupled together. The one or more wall modules form the individual space. Furthermore, the one or more wall modules include at least one plain wall module having a first frame and one or more panels secured to the first frame. The one or more modules also include at least one functional wall module having a frame and a modular conduit system secured to or within the frame of the functional wall module, wherein the at least one functional wall module conveys fluid into the individual space or removes fluid from the individual space.

Implementations of the present invention also include a method of setting up a modular wall installation capable of selective configuration and reconfiguration and further capable of conveying fluid to as well as removing fluid from an individual space. The method includes assembling a frame of a first functional wall module and securing a modular conduit system to or within the frame of the first functional wall module. The method also includes securing one or more panels to the frame of the first functional wall module. Moreover, the method includes selectively coupling the first functional wall module to one or more wall modules, thereby forming the individual space, wherein the one or more wall modules comprise one or more of a second functional wall module and a plain wall module.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which:

FIG. 3C illustrates a cross-sectional view of the functional wall module of FIG. 2B;

DETAILED DESCRIPTION OF THE PREFERRED EMBODIMENTS

Figure 1A:
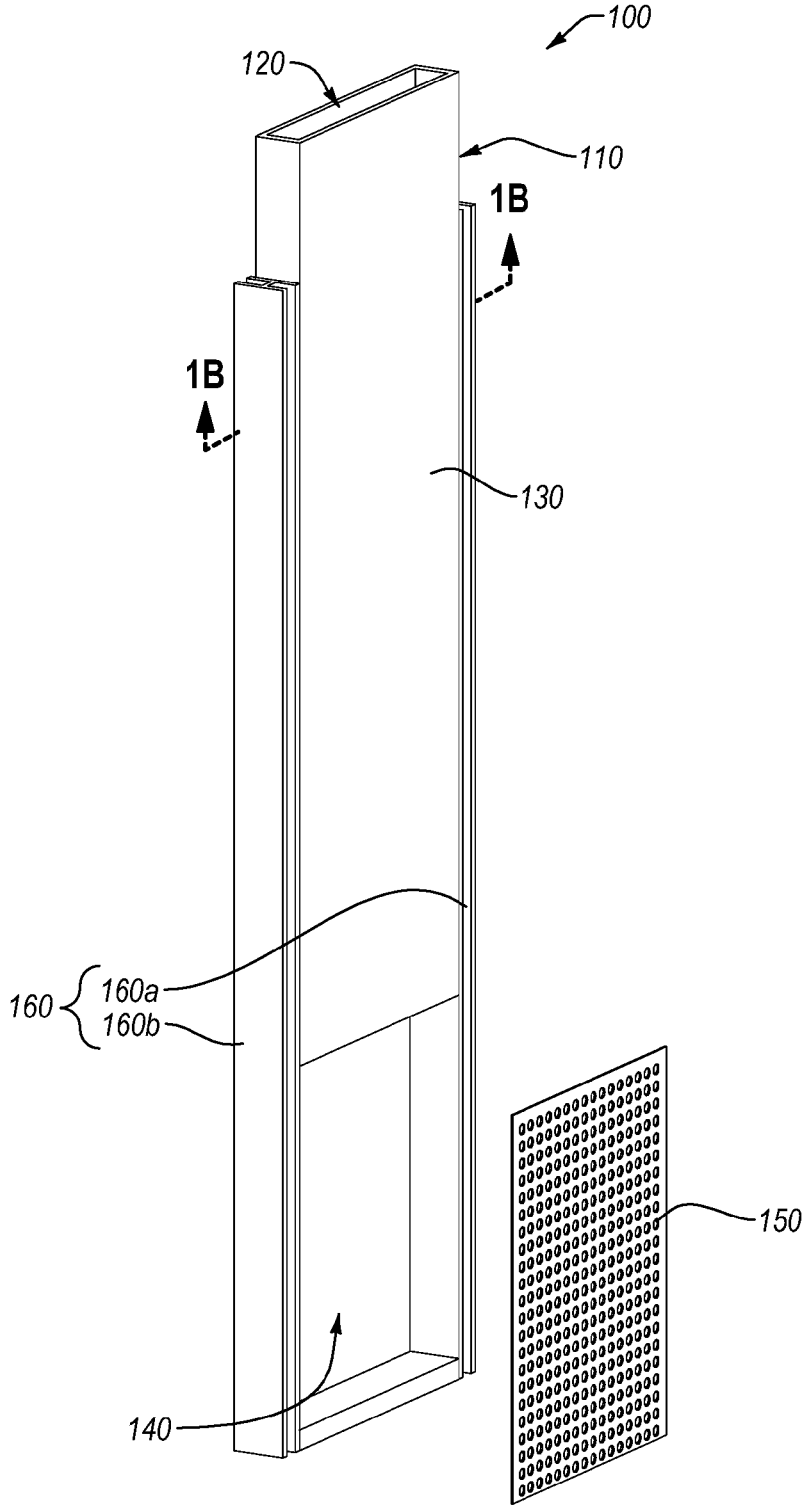
FIG. 1A illustrates a perspective view of a modular conduit system in accordance with one implementation of the present invention.

Implementations of the present invention provide systems, methods, and apparatus for delivering and/or removing fluid from a discrete location within a building. In particular, at least one implementation includes a modular conduit system that can supply or remove air, water, gas, or other fluids to/from an individual space created by modular walls. For example, a functional wall module can include one or more modular conduit systems. The modular conduit system within a modular wall (i.e., a wall comprising of one or more wall modules) can channel the fluid into and/or out of an individual space. Hence, a builder or installer can position such wall modules in a manner that permits users or occupants of the building to control temperature, humidity, air circulation, and air quality, etc. within the individual spaces in the building.

In one or more implementations, the modular conduit system can provide the builder or occupants of the building with the ability to control local environments within one or more individual spaces created or defined by modular walls. In particular, occupants of the building can control temperature, humidity, rate of air circulation, and/or air quality within the individual space by adjusting the amount of air introduced into and/or removed from such individual space via the modular conduit system. In addition to increased comfort, the modular conduit system also can reduce overall heating, cooling, and other costs associated with climate control within the building.

In at least one implementation, the modular conduit system can be integrated within modular wall segments that define the individual spaces. The modular conduit system can connect to existing conduits such as plumbing and sewer pipes and HVAC ducts (collectively "fluid distribution systems"), typically positioned near a ceiling or floor. Consequently, the conduit assemblies can receive air and water inflow from and provide outflow to respective existing fluid distribution systems of the building. Additionally, other utilities, such as natural gas, oxygen, and other gases, can pass through the modular conduit system.

The modular conduit system also can channel air from central air conditioning unit(s). Similarly, the modular conduit systems can serve as air outlets and can channel air out of the individual spaces, for instance, to improve air quality within a particular individual space. Furthermore, the modular conduit system can channel water into and waste water or sewer out of the individual spaces, which can permit users to install various outlets as well as equipment that requires water intake and/or disposal.

The modular nature of the wall modules also can permit the building's occupants to position the modular conduit systems in preferred locations. In particular, the occupant can position the modular conduit system in a manner that can create different temperature, humidity, air quality, etc., zones within the building, based on the occupant's particular needs. Furthermore, if or when the occupants' needs change, the occupants can reposition the wall modules and/or the modular conduit systems so as to conform to the changed needs.

Referring now to the Figures, FIG. 1A illustrates one exemplary implementation of a modular conduit system 100. As noted above, a manufacturer or installer can incorporate the modular conduit system 100 into a wall module, thereby configuring or forming a functional wall module. The modular conduit system 100 can include a modular conduit 110, which can channel fluid through the functional wall module and into and/or out of the individual spaces.

For ease of description, hereinafter, reference will be made to a "fluid" that can pass through the modular conduit 110. Additionally, examples of such fluids, as described herein, should not be interpreted as limiting and are provided only to further illustrative implementations of the invention. Furthermore, as used herein, the term "fluid" may refer to any liquid or gaseous matter, whether in natural, compressed or gasified state during channeling; examples of fluids include but are not limited to water, air, natural gas, nitrogen, $CO_2$, etc.

Accordingly, the modular conduit 110 can have such configuration that substantially prevents the fluid from escaping therefrom. For instance, the modular conduit 110 can prevent the fluid from escaping through any seams between walls thereof (e.g., the modular conduit 110 can have a welded construction, as further described below). Furthermore, the modular conduit 110 can have such configuration that allows the installer to connect the modular conduit 110 to a fluid deliver system, while substantially preventing loss of fluid about or near such connection.

The modular conduit 110 can have any number of suitable shapes and sizes, which can vary from one implementation to the next. The particular shape and size of the modular conduit 110 can depend on, among other things, the size of the wall module that will accept the modular conduit 110, the type of fluid the modular conduit 110 will carry, fluid pressure, material comprising the modular conduit 110, and the number of modular conduits 110 incorporated into the modular conduit system 100.

Furthermore, implementations also include the modular conduit 110 that can house and channel other conduits. Specifically, a single or multiple conduits can pass through and be housed within the modular conduit 110. For example, the modular conduit 110 can channel conduits that carry fluids, such as water, air, etc. Additionally or alternatively, the modular conduit 110 can channel conduits that carry wiring (e.g., electrical, communication, etc.), optical fiber, and the like. As such, the modular conduit 110 can provide an extra level or layer of protection and isolation for the conduits located therein.

In one implementation, the modular conduit 110 can have a substantially rectangular shape. For instance, incorporating a rectangular-shaped modular conduit 110 into the functional wall module that also has a rectangular cross-sectional shape, can allow the manufacturer to maximize the cross-sectional area of the modular conduit 110 (and, thus, the throughput threreof). It should be appreciated, however, that the modular conduit 110 can have any number of cross-sectional shapes and sizes (e.g., circular, oval, irregular-shaped, etc.).

Figure 2A:
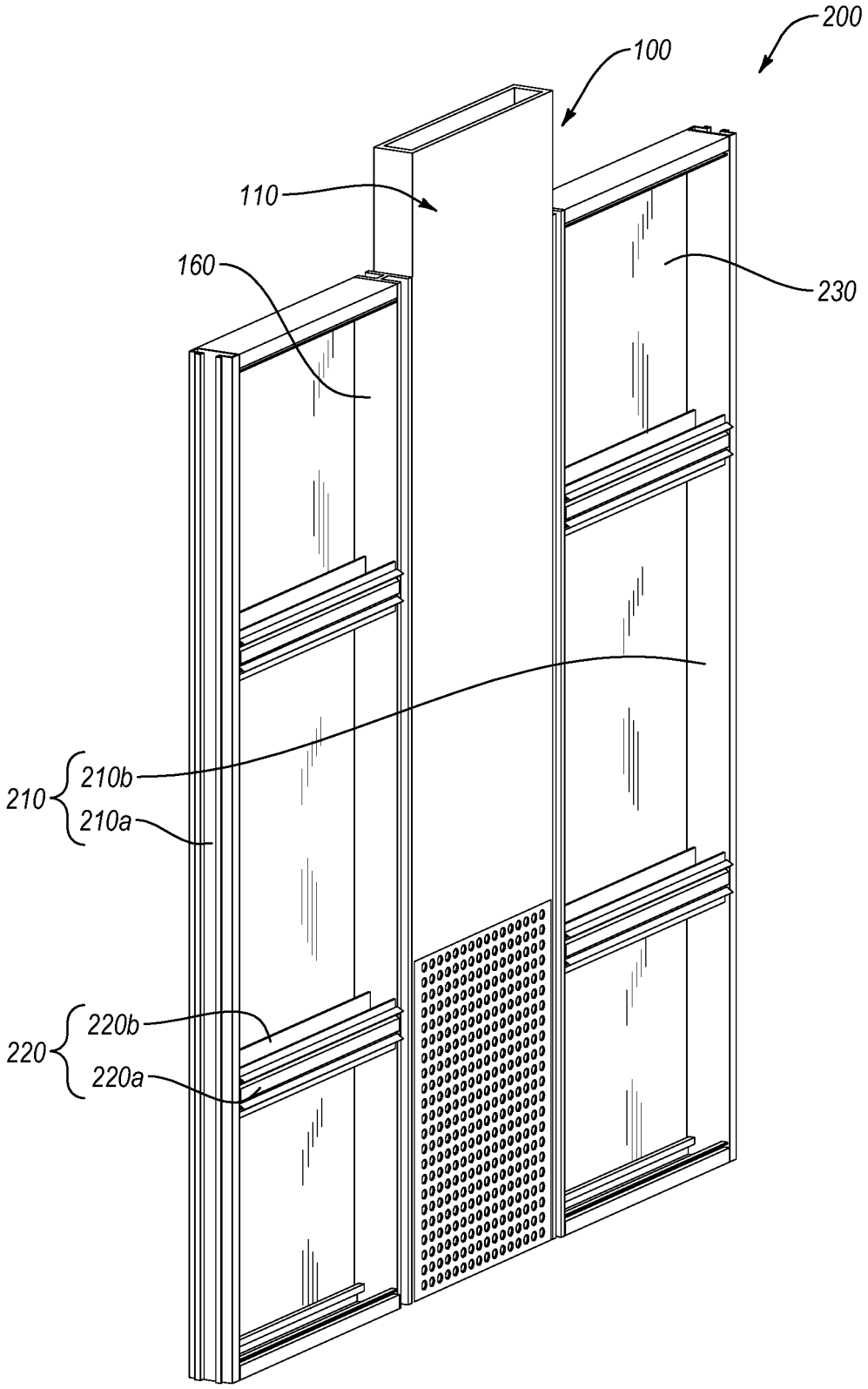
FIG. 2A illustrates a perspective view of a partially assembled functional wall module in accordance with one implementation of the present invention.
Figure 2B:
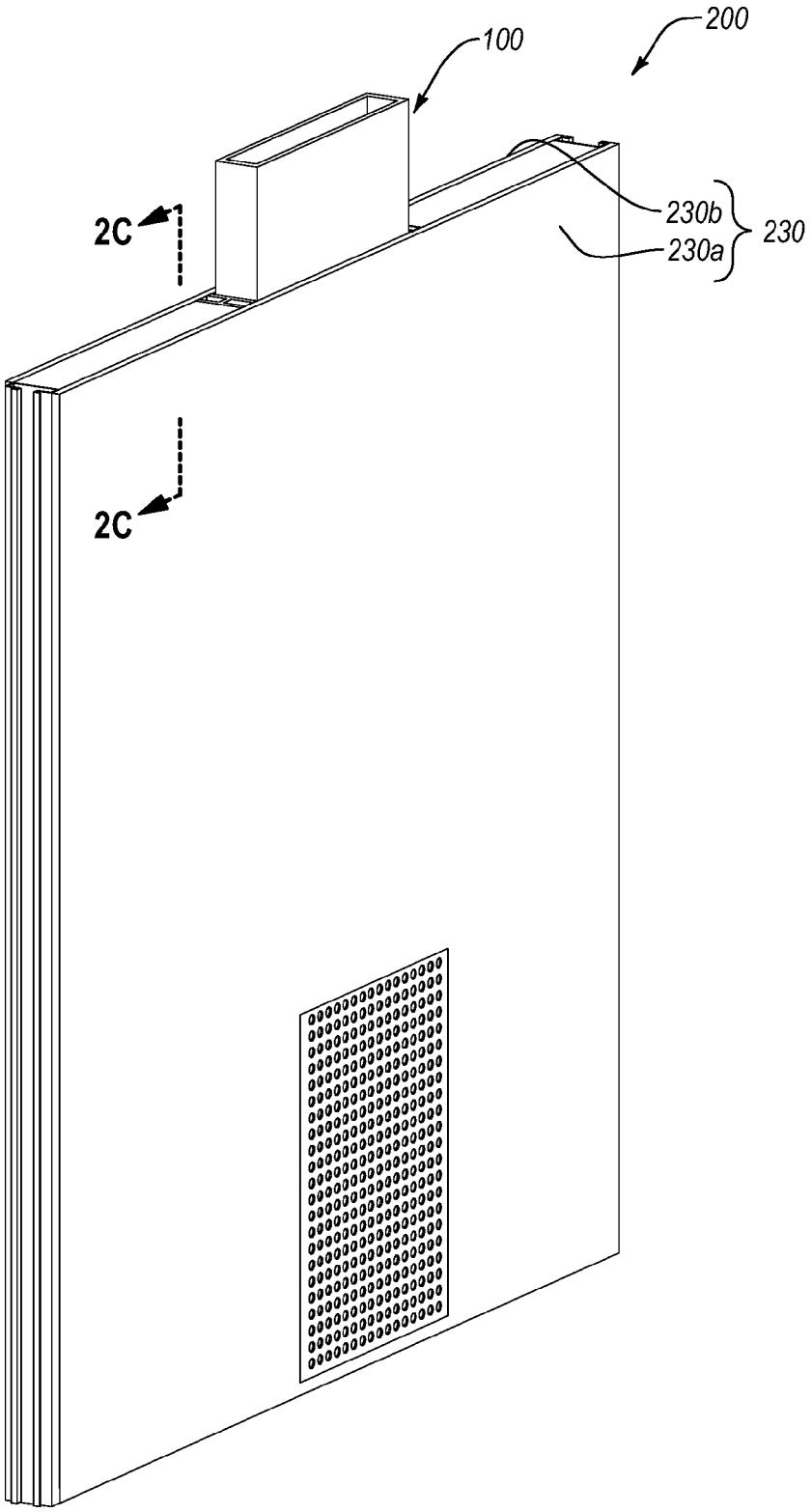
FIG. 2B illustrates a perspective view of a fully assembled functional wall module in accordance with one implementation of the present invention.

In any case, in at least one implementation, the modular conduit 110 can have a size and shape that can allow the installer to place or position the modular conduit 110 in the functional wall module (as shown in FIGS. 2A, 2B). For example, as shown in FIG. 1A, the modular conduit 110 can have a relatively small thickness (i.e., 1, 2, 3, 4, 5, or 6 inches) and a much larger width. Furthermore, the width of the conduit can be between 2 and 20 times the thickness of the conduit. In alternative implementations, the width of the modular conduit 110 can be less than 2 times or greater than 20 times the thickness. In any event, the manufacturer can maximize the width of the modular conduit 110 to provide for increased air flow, while also allowing the modular conduit 110 to fit within the functional modular wall.

In one or more implementations, the modular conduit 110 can comprise a metallic material, such as steel, aluminum, copper, or combination thereof. The modular conduit 110 also can comprise other materials, such as plastics and polymer fabrics. Specifically, the manufacturer can select an appropriate material for the modular conduit 110 based on the type of fluid that an installer desires to channel through the modular conduit 110, the pressure of the fluid, and the desired shape of the modular conduit 110.

Hence, implementations of the preset invention can include the modular conduit 110 that is substantially rigid, such that the installer can orient the modular conduit vertically without additional support. Alternatively, the modular conduit 110 can be relatively flexible, which can allow the modular conduit to bend (e.g., within the functional wall module). Moreover, in at least one implementation, the flexibility of the modular conduit 110 may require the installer to secure one or more supports thereto (as described further below), in order to orient the modular conduit 110 vertically, while avoid buckling or folding thereof.

Each modular conduit 110 can have a conduit inlet 120. Particularly, a main section 130 of the modular conduit 110 can have the conduit inlet 120 coupled thereto or integrated therewith. As noted above, conduit inlet 120 can have such configuration that can allow the manufacturer to couple the modular conduit 110 to the fluid distribution system in a manner that prevents or limits loss of fluid at or near the connection. For example, the inlet conduit inlet 120 can have a standard size, that can allow the installer to connect the modular conduit 110 to the fluid distribution system with standard connectors (e.g., flexible ducts or connector conduits), as further described below. Furthermore, the conduit inlet 120 also can have threaded inner and/or outer surfaces, which can couple to or with threaded fittings and connector conduits (e.g., NPT fittings and/or connector conduits).

The conduit inlet 120 can have substantially the same size and/or shape as the main section 130 (e.g., the conduit inlet 120 and the main section 130 can have substantially rectangular shapes). Alternatively, in at least one implementation, the conduit inlet 120 can have a different size and/or shape than the main section 130. For example, the main section 130 can have an approximately rectangular cross-sectional shape, while the conduit inlet 120 can have an approximately circular cross-sectional shape. Furthermore, the modular conduit 110 can have multiple conduit inlets 120 that connect to a single main section 130. Accordingly, the main section 130 also can facilitate mixing of different fluids and/or of fluids from different fluid distribution systems.

Still further, the modular conduit system 100 can include a register 140 that can allow the fluid, such as air, to flow out of the modular conduit 110 and into the individual space, and/or the reverse. As such, the register 140 can have openings or perforations therein, which can provide communication for the fluid to flow into and/or out of the modular conduit 110. For instance, the register 140 can comprise a front plate 150, such as a perforated diffuser plate, as shown in FIG. 1A. Additionally or alternatively, the front plate 150 of the register 140 can have elongated openings or channels that can allow the air to flow into and/or out of the register 140. In any event, the register 140 and the front plate 150 can allow the fluid to flow into and/or out of the modular conduit 110.

It should be appreciated that, in one or more implementations, the modular conduit 110 can incorporate multiple registers 140. Alternatively, the modular conduit system 100 can include the modular conduit 110 that does not incorporate any registers. For example, as described below in further detail, the modular conduit 110 can connect to a functional device located or positioned in the individual space. Furthermore, to the extent that the modular conduit 110 incorporates one or more registers 140, the builder or manufacturer can position such registers at any desired or preferred height and location along the modular conduit 110.

For instance, the builder can position the register 140 at the bottom of the modular conduit 110, such that the fluid can exit the modular conduit 110 near a floor of the individual space. Such configuration can present a particular advantage in heating applications, in which the fluid can be hot or heated air that can enter the individual space near the floor thereof. Thus, the individual space can have a more even temperature distribution. In at least one instance, a more even temperature distribution can lead to increased comfort of the occupants as well as reduced heating costs.

Similarly, the builder can position the register 140 at other locations along the modular conduit 110. For instance, when the modular conduit system 100 channels air out of the individual space, such as to clean the air (e.g., by removing undesirable particulates), the builder can position one or more registers at a location that necessitates the cleanest air. Additionally or alternatively, the builder can install multiple registers along one or more modular conduits 110. In at least one implementation, the builder also can install multiple modular conduit systems 100 within one individual space, which can channel various fluids into and out of the individual space. For example, such modular conduit systems 100 can have modular conduits 110 with registers located at different heights to channel air into and out of the individual space.

The register 140 also can have various configurations that can permit occupants to control the amount of air entering and/or exiting the individual space through the modular conduit system 100. For example, the register 140 can incorporate the front plate 150 that has louvers rotatable about an axis (e.g., in response to a movement of a lever). An occupant desiring to increase the amount of throughput through such register 140 can rotate the louvers into a more open position, which can allow more air to pass through the register 140.

In at least one implementation, the modularity of the modular conduit system 100 can allow the occupant or installer to reconfigure the modular conduit system 100, the modular conduit 110, and/or the register 140. Specifically, as described below in further detail, the occupant can access the modular conduit system 100, such as by removing one or more panels from the functional wall module. As such, for instance, the occupant can change location and/or position of the register 140 along the modular conduit 110. In one example, the occupant can position the register 140 at a lower location (e.g., near the floor of the individual space) during the colder months of the year, when the modular conduit system 100 can supply hot or heated air to the individual space. During the warmer months of the year, the occupant can reconfigure the modular conduit 110, such as to position the register 140 at a higher location, when the modular conduit system 100 may supply cold or cooled air into the individual space.

Additionally or alternatively, the front plate 150 of the register 140 also can function as a decorative piece. The builder can secure the front plate 150 to the modular conduit 110. In or more implementations, the front plate 150 can include texture, color, design, and/or other attributes that match similar attributes of the modular conduit system 100, the functional wall module, the panels of the functional wall module (described below), and combinations thereof.

In at least one implementation, the front plate 150 can couple to the modular conduit 110 in a manner that covers and/or conceals the register 140. In other words, the front plate 150 can provide a decorative façade, which can have a pleasing aesthetic, while allowing fluid to flow into and/or out of the modular conduit 110. The front plate 150 also can blend in with the panel of the functional wall module.

Generally, the front plate 150 can couple to the modular conduit 110 in any number of ways, which can vary from one implementation to another. For example, the front plate 150 and/or a portion of the modular conduit 110 can incorporate magnetic elements. Thus, the front plate 150 can magnetically couple to the modular conduit 110. Additionally or alternatively, the installer can couple the front plate 150 to the modular conduit 110 with screws, hook and loop connectors, snap-in connectors, as well as any number of suitable fasteners.

Furthermore, the modular conduit 110, the register 140, and the front plate 150 can cooperate in a manner that channels the fluid through the openings in the front plate 150, while limiting or preventing leakage of fluid near or about the connections therebetween. For instance, the register 140 and/or the front plate 150 can incorporate seals that would not permit air to pass between the front plate 150 and/or the register 140. Hence, the air can flow directly from the existing fluid distribution system, through the register 140, and into the individual space.

In one or more implementations, the modular conduit 110 can have multiple registers 140 or outlets that can face in different directions. Moreover, each modular conduit 110 within the modular conduit system 100 can have multiple registers 140 or outlets that face in different (e.g., in opposite) directions. For example, the modular conduit 110 can have two registers that face away from each other. Hence, the modular conduit system 100 can supply fluids to and/or remove fluids from two individual spaces, separated by the functional wall module that incorporates such modular conduit system 100.

The main section 130 also can have multiple vertical conduit supports 160 (e.g., left and right vertical conduit supports 160*a*, 160*b*). Such vertical conduit supports 160 can secure the modular conduit system 100 in a vertical position. Additionally or alternatively, the vertical conduit supports 160 can secure multiple modular conduit systems 100 together. For example, the vertical conduit supports 160 can allow the installer to couple a first modular conduit system 100 to a second modular conduit system 100. Furthermore, any number of modular conduit systems 100 can couple to and within a functional wall module, as described below in more detail. For instance, at least one of the vertical conduit supports 160 can couple to a vertical support of the functional wall module.

Furthermore, the vertical conduit supports 160 can secure the modular conduit 110 to a structural or permanent wall. For instance, the functional wall module can selectively couple to the structural or permanent wall (e.g., to the interior of an unfinished wall inside the building). Hence, the builder can incorporate the modular conduit system 100 into such functional wall module. In at least one implementation, the builder can secure the vertical conduit supports 160 to the structural or unfinished wall in addition to or in lieu of securing the vertical conduit supports 160 to one or more vertical supports of the functional wall module.

Additionally, as further described below, the vertical conduit supports 160 can have various features that can permit connecting the vertical conduit supports 160 to other elements. For example, the vertical conduit supports 160 can have features that allow the installer to secure a first modular conduit system 100 of one functional wall module to a second modular conduit system 100 within another functional wall module. Accordingly, various connection features can provide interconnectivity of the vertical conduit supports 160 with other elements and/or with components of the modular conduit system 100 as well as of the functional wall module, which can allow the installer to position the functional wall modules in various configurations.

Moreover, the vertical conduit supports 160 can provide additional structural support and rigidity to the modular conduit 110 and/or to the modular conduit system 100. As such, the manufacturer can fabricate the modular conduit 110 from essentially any material, which may have no or minimal structural rigidity (e.g., fabric, thermoplastic film, thin sheet material, etc.). Accordingly, the vertical conduit supports 160 can support such modular conduit 110 that otherwise may have insufficient structural integrity to remain in a vertical or upright position or configuration.

Figure 1B:
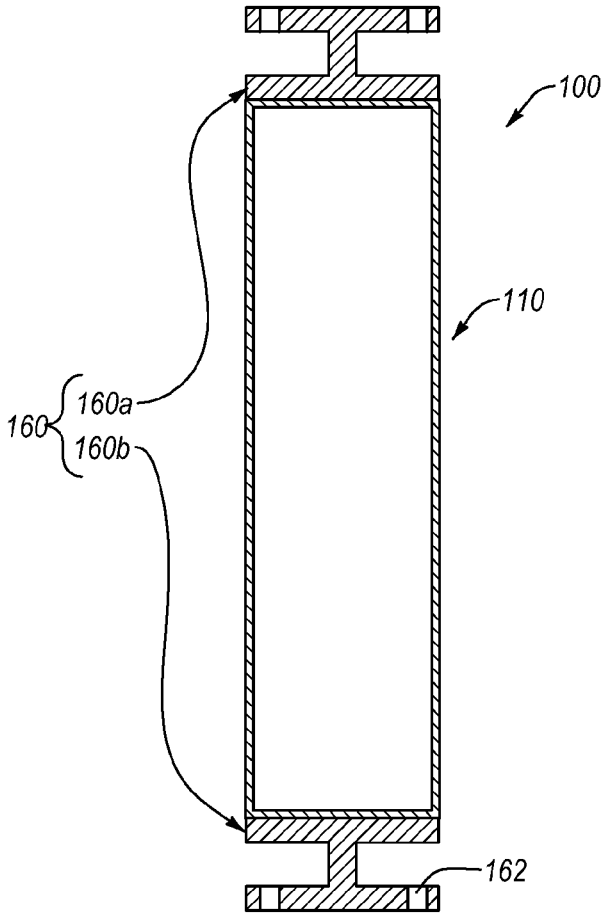
FIG. 1B illustrates a cross-sectional view of the modular conduit system of FIG. 1A.

The vertical conduit supports 160 can have any number of cross-sectional shapes and sizes, suitable for providing sufficient support to the modular conduit system 100 as well as allowing the installer to couple the vertical conduit supports 160 to various components or elements of the modular conduit system 100. For example, as illustrated in FIG. 1B, vertical conduit supports 160 can have an I-beam configuration. The manufacturer can couple the modular conduit 110 to the vertical conduit supports 160 (e.g., to the vertical conduit supports 160*a*, 160*b*) in any number of suitable ways, which among other things can depend on the particular material used for the modular conduit 110. In one example, the modular conduit 110 can comprise sheet-like metal. Hence, the manufacturer can weld (e.g., spot weld), fasten, glue, or otherwise secure the modular conduit 110 to the vertical conduit supports 160.

The vertical conduit supports 160 can have configurations and sizes that can allow the manufacturer or installer to secure the vertical conduit supports 160 to a support member (e.g., vertical or horizontal support member) of the functional wall module. For instance, the vertical conduit supports 160 can incorporate openings or perforations 162. The manufacturer can pass one or more fasteners through the perforations 162 to secure the vertical conduit supports 160 to horizontal supports of the functional wall module.

Figure 1C:
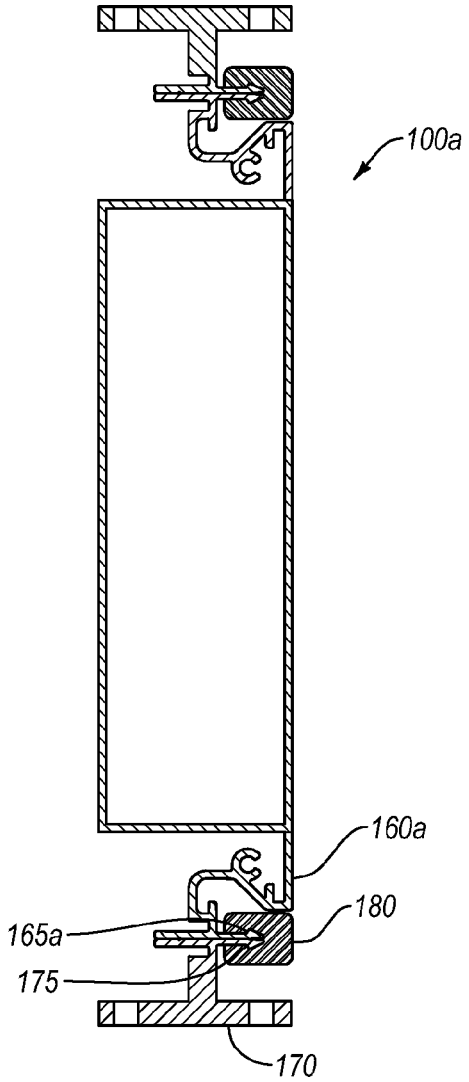
FIG. 1C illustrates a cross-sectional view of a modular conduit system in accordance with another implementation of the present invention.

In additional or alternative implementations, vertical conduit supports can allow the manufacturer to selectively and quickly couple the modular conduit system within the functional wall module. For example, as illustrated in FIG. 1C, a modular conduit system 100*a* can have a vertical conduit support 160*a* that can have a snap-in coupling with a vertical support 170 of the functional wall module. Except as otherwise described herein, the modular conduit system 100*a* and its components and elements can be similar to or the same as modular conduit system 100 (FIGS. 1A, 1B) and its respective components and elements. Such vertical support 170 can, in turn, couple to one or more horizontal supports of the functional wall module. Accordingly, the installer can easily and/or efficiently remove and/or replace the modular conduit system 100*a*.

Particularly, a snap-in connector 180 can secure the vertical conduit support 160*a* to the vertical support 170. In one implementation, the vertical conduit support 160*a* can have one or more connecting elements 165*a* (e.g., hook-like connecting elements). Correspondingly, the vertical support 170 also can include connecting elements 175. The connecting elements 165*a*, 175 can abut one another and form a snap-in protrusion. The snap-in connector 180 can fit about the abutting connecting elements 165*a*, 175, thereby securing the vertical conduit supports 160*a* to the vertical support 170. For instance, the snap-in connector 180 can have flexible sides, which can flex outward and allow the snap-in connector 180 to pass about the connecting elements 165*a*, 175.

It should be appreciated that the connecting elements 165*a*, 175 can have any desirable length along the connecting elements 165*a*. In one or more instances, the vertical conduit supports 160*a* can be an extrusion that incorporates the connecting elements 165*a*. Thus, the connecting elements 165*a* can have the same length as the vertical conduit supports 160*a*. Alternatively, however, the connecting elements 165*a* can have an interrupted configuration along the length of the vertical conduit supports 160*a*. In any event, the connecting elements 165*a* can have a suitable length along the vertical conduit supports 160*a*, such as to provide sufficient coupling of the vertical conduit supports 160*a* to the vertical support 170.

Such snap-in coupling of the vertical conduit supports 160*a* can allow the installer to quickly and easily remove and/or replace the modular conduit system 100*a*. Specifically, and as further discussed below, the installer can remove one or more panels from the functional wall module. Subsequently, the installer can remove the snap-in connector(s) 180, thereby decoupling the vertical conduit supports 160*a* from the vertical support 170. Thereafter, the installer can remove the modular conduit system 100*a* from the functional wall module and may replace it with another modular conduit system.

For instance, the installer can remove a first modular conduit system, which has a register located at the bottom thereof, and replace it with a second modular conduit system, which has a register located at the top thereof, and vice versa. Hence, for example, the installer can convert the functional wall module that supplies and/or removes air to/from the individual space based on seasonal changes. Particularly, as noted above, the installer can provide the second modular conduit system 100*a* during warmer months and the first modular conduit system 100*a* during the colder months of the year.

In any case, the installer can secure the modular conduit system 100*a* as well as modular conduit system 100 (FIGS. 1A, 1B) within a functional wall module. For example, FIGS. 2A, 2B illustrate one implementation of incorporating the modular conduit system 100 into a functional wall module 200. In particular, FIG. 2A illustrates the functional wall module 200 with a front panel removed therefrom. As such, the modular conduit system 100 is visible within the functional wall module 200. Furthermore, the removal of the front panel from the functional wall module 200 can allow the installer to reconfigure, remove, and/or replace the modular conduit system 100.

More specifically, the functional wall module 200 can comprise vertical supports 210 and horizontal supports 220, which together (at least partially) form a frame of the functional wall module 200. Particularly, in one instance, the functional wall module 200 can include left and right vertical supports 210*a*, 210*b*. Similarly, in one implementation, the functional wall module 200 can include front and back horizontal supports 220*a*, 220*b*, which can couple to the vertical supports 210.

Furthermore, the functional wall module 200 can include multiple sets of front and back horizontal supports 220*a*, 220*b*. The frame comprising of such vertical supports 210 and horizontal supports 220 can provide the desired or necessary rigidity and structural stability for the functional wall module 200. Additionally, as described below in further detail, the frame can incorporate various attachment features, which can allow the installer to secure one or more panels thereto.

In at least one implementation, the frame also can include the modular conduit system 100 or portions thereof. For example, the horizontal supports 220 can couple to the vertical supports 210 on a first side thereof and can couple to the vertical conduit supports 160 (as described above) on a second side thereof. Accordingly, in at least one instance, the frame can include the vertical conduit supports 160 of the modular conduit system 100, which can provide additional structural stability and/or rigidity to the functional wall module 200.

As described above, such modular conduit system 100 can connect to existing modular wall segments, existing walls, plain wall modules, functional wall modules 200, and combinations thereof. To make the modular conduit system 100 more aesthetically pleasing (or less obvious or noticeable), the builder can cover the modular conduit system 100 with one or more panels.

Thus, in at least one implementation, the frame can allow the builder or installer to secure one or more panels 230 thereto, as further described below. The installer can secure the panels 230 on opposing sides of the functional wall module 200. As noted above, the functional wall module 200 can couple to and/or conceal an unfinished wall, such as a structural wall of the building. Accordingly, in at least one implementation, the functional wall module 200 can have a single panel 230 secured to the frame thereof.

Furthermore, the installer can quickly and easily disassemble the functional wall module 200 and remove and replace the modular conduit system 100. In particular, the installer can remove one or more panels 230 from the functional wall module 200, thereby exposing and providing access to the modular conduit system 100. Subsequently, the installer can remove, modify, repair, and/or replace the modular conduit system 100 as well as any portion thereof. Moreover, modular configuration of the functional wall module 200 as well as of the modular conduit system 100 can simplify maintenance repair, removal, and/or replacement of the modular conduit system 100.

In one or more implementations, the modular conduit system 100 does not include vertical conduit supports 160. For instance, the modular conduit system 100 can have a size and configuration that can allow the installer to insert the modular conduit system 100 between vertical supports 210*a*, 210*b* of the functional wall module 200. Thus, in one or more implementations, the installer can use the modular conduit system 100 to retrofit existing plain wall modules into the functional wall modules, such as the functional wall module 200.

As mentioned above, the panels 230 can conceal the modular conduit system 100 within the functional wall module 200, thereby providing a pleasing aesthetic of the functional wall module 200 to the occupants. For example, as illustrated in FIG. 2B, the functional wall module 200 can incorporate a front panel 230*a* and a back panel 230*b*. Collectively, the panels 230 can at least partially conceal the modular conduit system 100.

The panels 230 can have any number of shapes, sizes, and configurations, which can vary from one implementation to another. More specifically, the installer can choose the particular color, texture, transparency and translucency, and/or general appearance of the panels 230 based on a particular interior design and/or occupants' preferences. Likewise, the panels 230 can comprise any number of suitable materials, such as thermoplastic sheets, fabrics, polymer sheets, and the like. In any event, the panels 230 can couple to the frame of the functional wall module 200 and can conceal the modular conduit system 100 within the functional wall module 200.

Figure 2C:
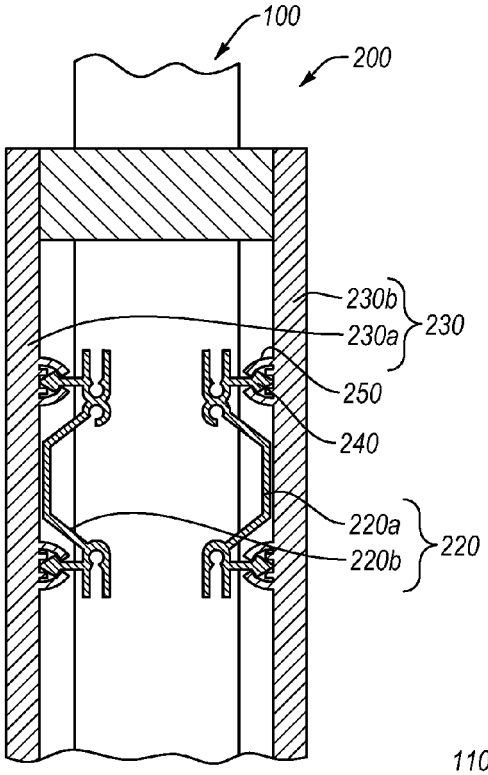

In one or more implementations, as illustrated in FIG. 2C, the panels 230 (e.g., the panels 230*a*, 230*b*) can couple to the horizontal supports 220, such as to the respective horizontal supports 220*a*, 220*b*. In one example, the horizontal supports 220 can have two snap-in protrusions 240. The snap-in protrusions 240 can include undercutting portions, which can secure corresponding snap-in connectors 250 of the panel 230. Accordingly, the panels 230 can snap and couple to the horizontal supports 220.

As described above, the installer can remove the panels 230 from the functional wall module 200, thereby exposing and providing access to the modular conduit system 100. For example, the installer can pull on the panel 230 and decouple the snap-in connectors 250 from the snap-in protrusions 240. Subsequently, the installer can simply remove the panel 230, while having the ability to reattach the panel 230 to the horizontal supports 220 at a later time.

It should also be appreciated that the frame as well as panels 230 can have any number of suitable configurations, which can allow the installer to selectively couple the panels 230 to the frame of the functional wall module 200. For instance, the horizontal supports 220 can have any number of the snap-in protrusions 240 connected thereto or incorporated therewith. Likewise, the panels 230 can have a corresponding number of the snap-in connectors 250, which can snap about the snap-in protrusions 240, thereby coupling the panels 230 to the horizontal supports 220.

Moreover, the panels 230 can incorporate magnetic elements which can magnetically couple or secure the panels 230 to the frame. Additionally, and to the extent that the horizontal supports 220 and/or vertical supports comprises a non-magnetic material (e.g., aluminum), the horizontal supports 220 and the vertical supports also can include corresponding magnetic elements which can allow the panels 230 to couple thereto. Also, the installer can couple and secure the panels 230 to the horizontal supports 220 and/or to the vertical supports with various fasteners, which can allow the installer to selectively remove and reattach the panels 230 (e.g., hook and loop connectors, screws, etc.).

Figure 3:
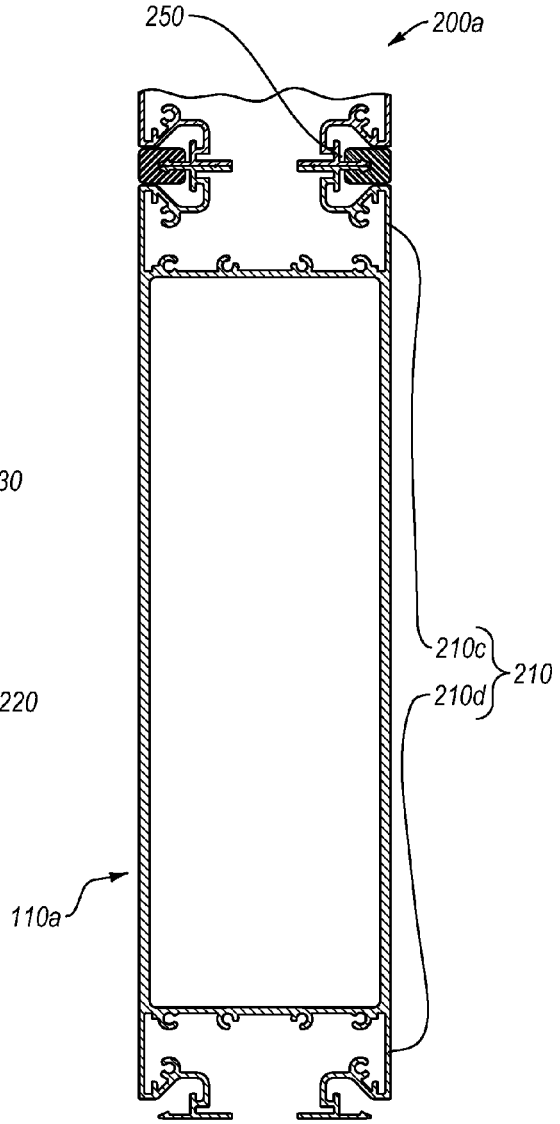
FIG. 3 illustrates a cross-sectional view of a functional wall module in accordance with another implementation of the present invention.

Additionally, the modular conduit system can have integrated conduit, supports, and/or panels. In at least one implementation, as illustrated in FIG. 3, a functional wall module 200*a* can have subcomponents that can combine and/or assemble into an entity without visible divides. Except as otherwise described herein, the functional wall module 200*a* and its components and elements can be similar to or the same as the functional wall module 200 (FIGS. 2A-2C) and its respective components and elements. For example, the functional wall module 200*a* can comprise a single or unitary extrusion that incorporates a modular conduit 110*a*. As such, the functional wall module 200*a* can seamlessly and unnoticeably connect to existing modular wall segments, plain wall modules, and/or other structures.

In at least one implementation, the functional wall module 200*a* can include vertical supports 210*c*, 210*d* (whether integrated with or secured to the modular conduit 110) having connecting elements 250, which can interface with the snap-in connector 180. One or more snap-in connectors 180 can secure various vertical supports 210 one to another. For instance, the installer can couple or connect various vertical supports 210, thereby forming desired sequences of the functional wall modules 200*a*, plain wall modules, and modular wall segments (as further described below in connection with FIGS. 4A, 4B). It should be appreciated that the vertical supports 210*a*, 210*b* (FIGS. 2A, 2B) can have similar or the same connecting elements 250, which can allow the installer to secure the functional wall module 200 (FIGS. 2A, 2B) to other wall modules and modular wall segments.

Moreover, when particular needs or requirements of the occupant's change, the installer can decouple the snap-in connectors 250 and can reposition the functional wall module 200*a* and/or the modular walls connected thereto, based on new requirements. Also, uncoupling the snap-in connectors 250 from the vertical supports 210 can allow the installer to service or repair the functional wall module 200*a* as well as replace the functional wall module 200*a* and any of the wall modules or wall segments connected thereto. Accordingly, such modular coupling provided by the vertical supports 210 and connecting elements 250 can provide more flexibility for the installer as well as for the occupants of the building, which may reduce operating cost thereof.

Additionally, modular conduit 110*a* can have integrated or uninterrupted conduit walls. In one or more implementations, one or more panels can at least partially form or define the conduit walls, which can be visible to the occupants of the individual spaces. Accordingly, the conduit walls can incorporate various decorative elements and can provide aesthetically pleasing views to the occupants. For example, the conduit walls can comprise decorative panels, such as thermoplastic panels that have aesthetically pleasing appearances.

Furthermore, the integrated conduit walls (or panels) can incorporate one or more registers, located anywhere along the length of the modular conduit 110*a*. The conduit walls and/or panels also can form outlets and/or inlets for the fluid to flow into and out of the individual space, respectively. For example, the integrated conduit walls can have perforations in desired locations, which can permit the air to flow into or out of the individual space.

Moreover, the functional wall module 200*a* can have integrated vertical supports 210*c*, 210*d* that, together with the modular conduit 110*a*, can form a single or unitary functional wall module 200*a*. Hence, the vertical supports 210*c*, 210*d*, in addition to providing structural rigidity and support to the modular conduit 110*a* and/or to the functional wall module 200*a*, can have an aesthetically pleasing appearance (e.g., such as to compliment or blend in with adjacent wall modules). For instance, a portion of the vertical supports 210*c*, 210*d* that is visible to the occupants can have appealing aesthetic, which can match the conduit walls or panels of the functional wall module 200*a*. In at least one implementation, the conduit walls and the vertical supports 210*c*, 210*d* can share a surface that can appear to the occupants as a single or unitary surface.

In one or more implementations, the modular conduit system and/or the functional wall module 200*a* can have panels that incorporate a channel therein, which can form a conduit within such panels. Furthermore, implementations of the present invention also include a modular conduit system that can have integrated panels 230. Additionally or alternatively, the modular conduit system can have a configuration that allows the installer to secure the panels thereto, as noted above.

It should be appreciated that the panels of the functional wall module also can couple to the frame thereof in a manner that prevents or limits leakage of fluid near or through the connections therebetween. In other words, once coupled to the vertical and/or horizontal supports of the functional wall module, the panels can form or define a modular conduit within such wall module. Accordingly, the fluid (e.g., air) can enter the functional wall module between the panels thereof. Furthermore, the panels can incorporate opening or perforations (e.g., similar to the front plate 150 (FIG. 1A)), which can allow the fluid to enter or exit the functional wall module and flow into or out of the fluid distribution system, coupled to the functional wall module.

Generally, the installer can integrate or couple the functional wall modules with other wall modules (e.g., functional or plain wall modules) and modular wall segments of existing or new partitions and modular walls. For instance, the functional wall modules, plain wall modules, modular wall segments, and similar structures can form individual spaces of various shapes, sizes, and use configurations. Such individual spaces include but are not limited to offices, kitchens, conference rooms, labs, and clean rooms. The functional wall modules can have a desired configuration and shape depending on a particular use and a particular individual space that the functional wall modules or the modular conduit system services.

In one or more implementations, the functional wall modules can have a substantially flat, arcuate, wave-like, or other desired shapes, depending on the occupants' preferences. Additionally or alternatively, the builder or occupants of a building can use functional wall modules to conceal a permanent or temporary wall or partition. In particular, the builder can secure the functional wall modules as well as other modular wall segments or similar structures to an unfinished wall. Such functional wall modules and other structures can enhance overall aesthetic appeal of the occupants' environment.

Figure 4A:
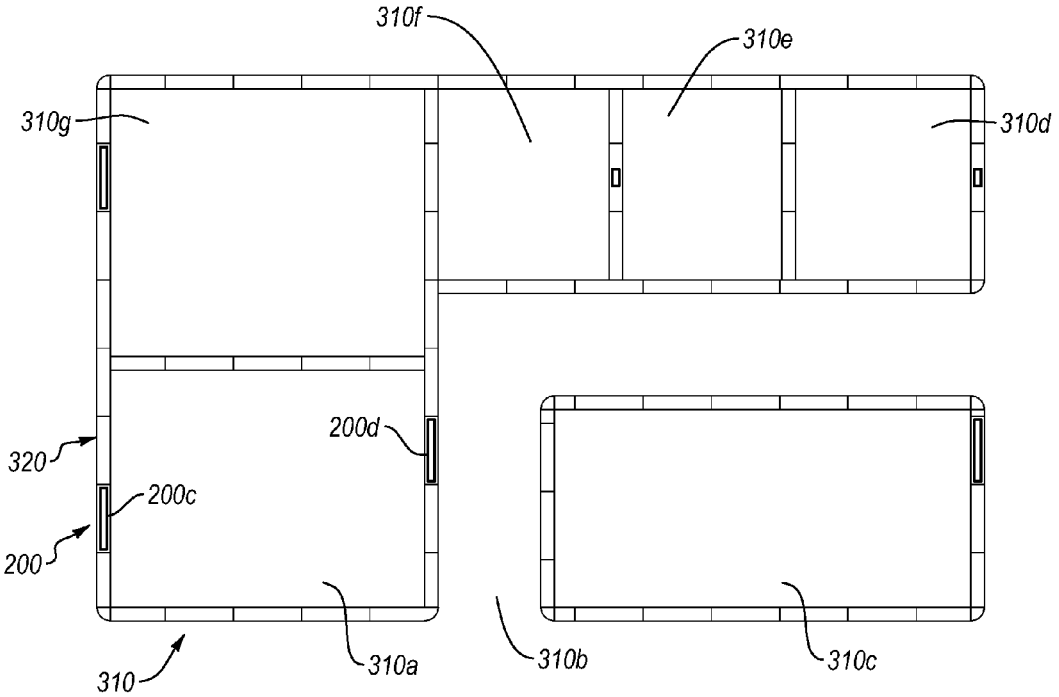
FIG. 4A illustrates a plan view of a modular wall installation in accordance with one implementation of the present invention.
Figure 4B:
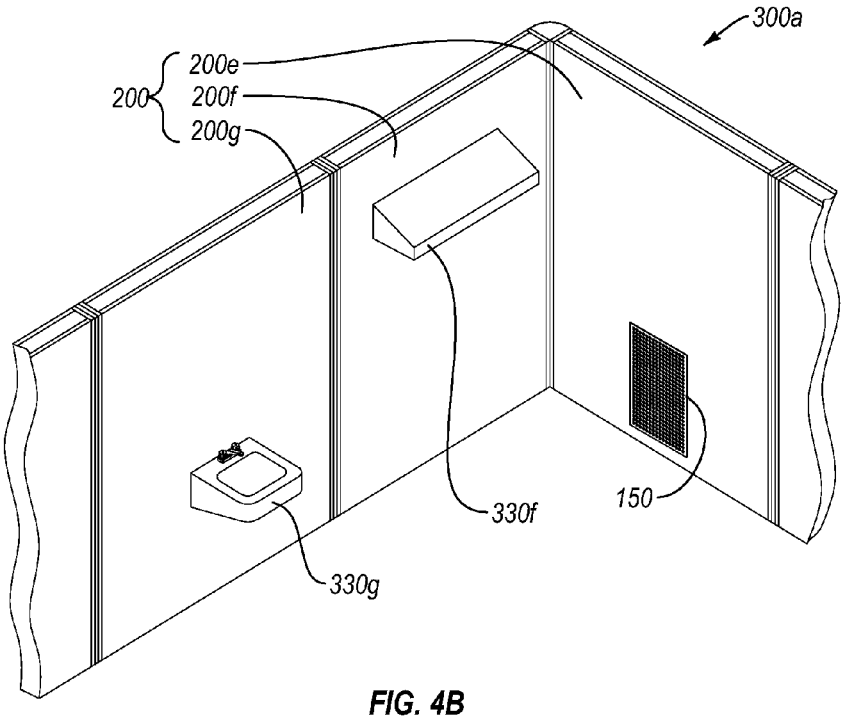
FIG. 4B illustrates a perspective view of a portion of a modular wall installation in accordance with another implementation of the present invention.

In any event, the builder can assemble multiple wall modules, include functional wall modules and plain wall modules into a modular wall system installation, which can provide flexibility for configuring and reconfiguring individual spaces within the building. FIGS. 4A, 4B illustrate exemplary implementations of modular wall installations 300, 300*a*. Particularly, as illustrated in FIG. 4A, the modular wall installation 300 can include multiple wall modules that define individual spaces 310 (e.g., 310*a*, 310*b*, 310*c*, 310*d*, 310*e*, 310*f*, 310*g*) within a building. For instance, as further described below, multiple plain wall modules 320 and/or functional wall modules 200 can selectively couple together in various arrangements to form the individual spaces 310. It should be understood that, although reference herein is made to the functional wall modules 200 (FIGS. 2A, 2B), the modular wall installation 300 also can incorporate the functional wall modules 200*a* (FIG. 3) or any other functional wall modules in a similar manner.

The individual spaces 310 can have any number of suitable shapes and sizes, which can vary from one implementation to another. Furthermore, as mentioned above, the individual spaces 310 can have fluid supply or removal therein. More specifically, one or more functional wall modules 200 can at least partially form the individual spaces 310 and, thus, can supply fluid thereto and/or remove fluid therefrom. In one or more implementations, the functional wall module 200 can be sized and configured to allow the functional wall module 200 to connect to other functional wall modules and/or to plain wall modules 320.

For example, the individual space 310*a* can comprise functional wall modules 200*c*, 200*d* coupled to the respectively adjacent plain wall modules 320. Hence, the functional wall modules 200*c*, 200*d* together with the plain wall modules 320 can form the general shape and size of the individual space 310*a* (e.g., the individual spaces 310*a* can have a substantially rectangular shape). As described above, the functional wall modules 200*c*, 200*d* can supply one or more fluids to and/or remove one or more fluids from the individual space 310*a*.

In at least one implementation, the same functional wall module 200 (e.g., the functional wall module 200*c* and/or the functional wall module 200*d*) can both supply fluid to the individual spaces 310*a* and remove fluid from the individual space 310*a*. For instance, the functional wall module 200*c* can supply conditioned air into the individual space 310*a* as well as remove air from the individual space 310*a*, such as to cool, to heat, and/or to otherwise condition the air. Alternatively, a first functional wall module 200 (or a first set of functional wall modules 200) can supply the fluid into the individual space 310*a*, and a second functional wall module 200 (or a second set of functional wall modules 200) can remove the fluid from the individual space 310*a*. For example, the functional wall module 200*c* can supply the conditioned air into the individual space 310*a*, and the functional wall module 200*d* can remove the air from the individual space 310*a*, and vice versa.

Furthermore, a single functional wall module 200 can service multiple individual spaces 310. Hence, implementations of the present invention can include the functional wall module 200 that at least partially forms or defines two separate and/or adjacent individual spaces 310. For example the functional wall module 200*d* partially defines the individual space 310*a* and the adjacent individual space 310*b*. As such, the functional wall module 200*d* may supply fluid into the individual space 310*a* and/or individual space 310*b* as well as remove fluid therefrom.

The functional wall modules 200 can connect to existing fluid distribution systems within the building. In or more implementations, the functional wall modules 200 can connect to an existing overhead fluid distribution system. In at least one instance, the fluid distribution system conduit can connect to a central distribution center, such as a heating and/or air conditioning unit (or multiple units). Hence, the existing fluid distribution systems can provide a channel for fluid to flow into and/or out of the functional wall module 200.

Additionally or alternatively, the builder can add new segments (e.g., overhead ducts) that connect to the existing fluid distribution system unit ("air handler"), which can provide heating, cooling, air conditioning, air filtration, etc. The builder or installer can then connect such new connector conduit to the functional wall module 200. Similarly, if the chosen location of the functional wall module 200 does not perfectly coincide with an existing fluid distribution system, the builder can add connector conduits, such as flexible ducts, to connect the functional wall module 200 to the existing fluid distribution system. Additionally or alternatively, the builder can add permanent ducts or connector conduits that can connect the functional wall module 200 to the (existing or new) fluid distribution center, such as an air handler at a desired location.

As further described below, the functional wall modules 200 can provide outlets, inlets, and/or other connection ports, for connecting functional devices or systems. The functional wall module 200 also can have inlets and/or outlets that can allow the fluid to flow into and/or out of the individual spaces 310. For example, as illustrated in FIG. 4B, a modular wall installation 300*a* can include multiple functional wall modules 200, such as functional wall modules 200*e*, 200*f*, 200*g*. It should be noted that the particular connections or arrangements of the functional wall modules 200 illustrated in FIG. 4B are only exemplary, and, as noted above, the modular wall installation 300*a* can have any number of functional wall modules 200 and/or plain wall modules connected or positioned in various suitable arrangements, which can vary from one implementation to another.

In one implementation, the functional wall module 200*e* includes the modular conduit system that has a register (concealed by the front plate 150), which can supply air into the individual space or remove air therefrom, as described above. As noted above, the functional wall modules 200 also may have inlets and/or outlets that provide for connecting functional devices. For example, functional wall module 200*f* can incorporate an outlet for connecting a functional device 330*f*, which can remove air or gases from the individual space, through the functional wall module 200*f* and, subsequently, into the fluid distribution system. In one example, the functional device 330*f* is a hood, which can remove air from a localize section of the individual space and force such removed air through the functional wall module 200*f* and into a fluid distribution system. In at least one instance, the fluid distribution system can, thereafter, exhaust and/or filter the air removed by the hood.

Additionally or alternatively, in one or more implementations, the modular wall installation 300*a* can include the functional wall module 200*g*, which can supply liquid to a functional device 330*g* (e.g., a sink). Likewise, the functional wall module 200*g* also can remove liquid from the individual space at least partially defined by the functional wall module 200*g*. Specifically, the functional wall module 200*g* can remove liquid from the functional device 330*g*.

In light of this disclosure, it should be apparent to those skilled in the art that a horizontal support surface, such as a floor can support the modular wall installation 300*a* as well as the functional wall modules 200. For instance, the building can have a suspended floor that can support the functional wall modules 200, plain wall modules, and modular wall segments. Moreover, the suspended floor can house and/or conceal one or more fluid distribution systems (e.g., air distribution system, sewer system, plumbing, etc.).

The functional wall modules 200 also can have any suitable height, which can vary from one implementation to the next. For example, one or more of the functional wall modules 200 can have a partial height, such that a top of the functional wall module 200 does not reach the ceiling (or suspended ceiling) inside the building. Alternatively, the functional wall modules 200 can have full height, such that the tops of the functional wall modules 200 approximately abut the ceiling. It should be appreciated that the ceiling, such as a suspended ceiling, also can house and conceal one or more fluid distribution systems. Hence, in at least one implementation, the functional wall module 200, the ceiling, and/or the floor can conceal one or more fluid distribution systems as well as the ducts or other connector conduits that connect the functional wall modules 200 to such fluid distribution systems.

Furthermore, it should be appreciated that modularity of the modular wall installation 300*a* can allow the installer to provide fluids at essentially any desired location or individual space within the building. Likewise, the modular wall installation 300*a* can remove fluids essentially from any location or individual space within the building. Moreover, when occupants' need change, the installer or occupants can readily and quickly rearrange the functional wall module 200 and plain wall modules to reconfigure the modular wall installation and/or the individual spaces as desired or preferred.

Figure 5:
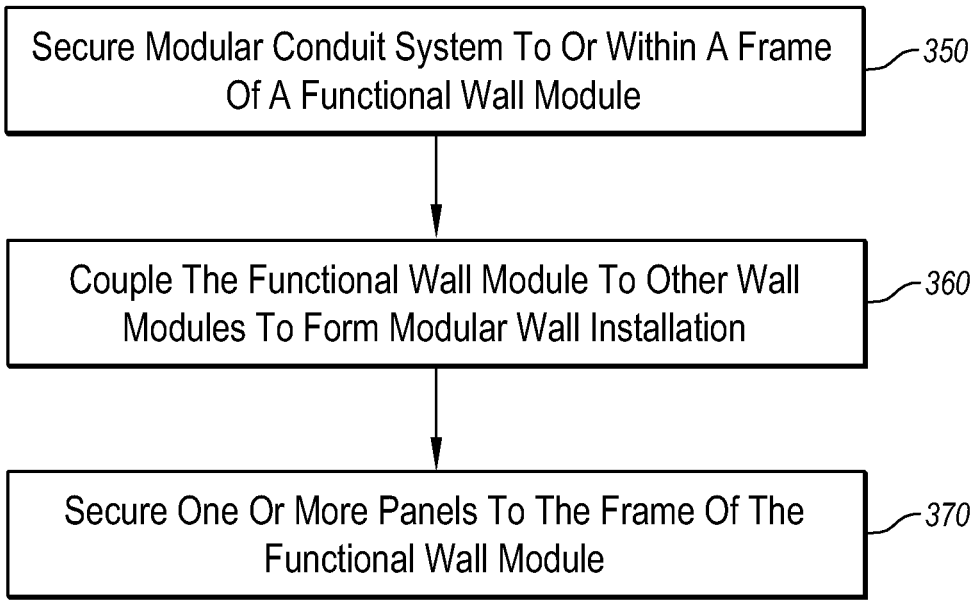
FIG. 5 illustrates a chart of acts of a method for setting up a modular wall installation in accordance with one implementation of the present invention.

Accordingly, FIGS. 1A-4B and the corresponding text provide a number of different components and mechanisms for creating modular conduit systems, functional wall modules, and modular wall installations. In addition to the foregoing, implementations of the present invention also includes a method of installing the modular conduit system and/or setting up modular wall installations, which can be described in terms of flowcharts comprising acts and steps in a method for accomplishing a particular result. For example, FIG. 5 illustrates a flowchart of one exemplary method for setting up a modular wall installation. The acts of FIG. 5 are described below with reference to the components and diagrams of FIGS. 1A through 4B.

For example, FIG. 5 illustrates that in one implementation, a method for setting up the modular wall installation 300, 300*a* can include an act 350 of securing the modular conduit system 100, 100*a* to or within the frame of the functional wall module 200, 200*a*. For example, the installer can prepare or assemble the frame of the functional wall module 200, 200*a*. In particular, as described above, the frame of the functional wall module 200, 200*a* can comprise vertical supports 210 (e.g., left and right vertical supports 210*a*, 210*b*) and/or horizontal supports 220 (e.g., front and back horizontal supports 220*a*, 220*b*). The vertical supports 210 and the horizontal supports 220 can couple together to form the frame of the functional wall module 200, 200*a*.

Hence, the installer can couple or secure the modular conduit system 100, 100*a* to the vertical and/or horizontal supports 210, 220. In one implementation, the installer can secure vertical conduit supports 160 (e.g., left and right vertical conduit supports 160*a*, 160*b*) to the horizontal supports 220 of the frame. For instance, the vertical conduit supports 160 can have screw-in or snap-in connections with the horizontal supports 220. Additionally or alternatively, the vertical conduit supports 160 also can couple to the vertical supports 210.

In addition, the method can include an act 360 of coupling the functional wall module 200, 200*a* to other wall modules to form the modular wall installation 300, 300*a*. In some instances, the functional wall module 200, 200*a* can selectively couple to other functional wall modules, which also can provide fluid to and/or remove fluids from the individual spaces 310 (e.g., individual spaces 310*a*, 310*b*, 310*c*, 310*d*, 310*e*, 310*f*, 310*g*). Additionally or alternatively, the functional wall module 200, 200*a* can selectively couple to one or more plain wall modules. In any event, one or more functional wall modules 200, 200*a* as well as one or more plain wall modules can couple together to form the modular wall installation 300, 300*a*, which can provide various individual spaces 310.

Furthermore, as mentioned above, the installer can easily decouple the functional wall module 200, 200*a* from adjacent wall modules and/or wall segments. As such, the installer can reconfigure the individual spaces 310 when occupants' needs change. For instance, the installer can add or remove functional wall modules 200, 200*a* to/from the individual spaces 310. Additionally or alternatively, the installer can replace the one functional wall module 200, 200*a* with another (e.g., different) functional wall module 200, 200*a*. In any event, selective coupling of the functional wall modules 200, 200*a* with adjacent wall modules and modular wall segments can allow the occupants to modify the individual spaces 310 on demand and without demolishing or damaging existing structures.

Moreover, the vertical and/or horizontal supports 210, 220 can allow the manufacturer to couple one or more panels 230 to the frame of the functional wall module 200, 200*a*. Hence, in one example, the method also includes an act 370 of securing one or more panels 230 (e.g., front and back panels 230*a*, 230*b*) to the frame of the functional wall module 200, 200*a*. In particular, according to one implementation of the present invention, the panels 230 can couple to the front and/or back horizontal supports 220*a*, 220*b*. For example, as mentioned above, the panels 230 can snap to the horizontal supports 220*a*, 220*b*.

Hence, the installer or occupants can selectively remove and/or reattach the panels 230 from/to the functional wall module 200, 200*a*. Consequently, the installer can conceal the modular conduit system 100, 100*a* behind one or more panels 230. Furthermore, by removing the one or more panels 230 from the frame of the functional wall module 200, 200*a*, the installer can gain access to and can perform work on the modular conduit system 100, 100*a*.

It should be appreciated that the present disclosure is not limited to a particular sequence of acts described above. In fact, the acts 350, 360, and 370 can be performed in any number of sequences, which can vary from one implementation to another. For example, the method can include the act 370 of securing one or more panels 230 to the frame of the functional wall module 200, 200*a* that occurs before the act 360 of coupling the functional wall module 200, 200*a* to other wall modules to form the modular wall installation 300, 300*a*. Moreover, implementations of the above-described method need not necessarily include every single act described herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A functional wall module for at least partially forming an individual space and for providing fluids into the individual space or for removing fluids therefrom, the functional wall module comprising:

one or more vertical supports;

one or more horizontal supports secured to at least one of the one or more vertical supports; and a modular conduit system coupled to at least one of the one or more vertical support or at least one of the one or more horizontal supports, the modular conduit system comprising:

a modular conduit sized and configured for one or more of delivering fluids to the individual space and extracting fluids from the individual space, the modular conduit being movable vertically between the vertical supports, allowing a register to be repositioned by a user from a first vertical position to a second different vertical position in the functional wall module, the register incorporating one or more seals that channel the flow of fluid through the register;

one or more vertical conduit supports coupled to and at least partially supporting the modular conduit and the functional devices connected thereto, the one or more vertical conduit supports further being coupled to at least one of the one or more vertical supports and one or more horizontal supports; and one or more panels removably secured to at least one of the one or more vertical supports or to at least one of the one or more horizontal supports, wherein the one or more panels have a snap-in connection with the at least one of the one or more vertical supports and the one or more horizontal supports.

2. The functional wall module as recited in claim 1, wherein the modular conduit includes one or more user-installable outlets with interfaces for receiving functional devices.

3. The functional wall module as recited in claim 2, further comprising one or more functional devices connected to the one or more user-installable outlets of the modular conduit.

4. The functional wall module as recited in claim 2, wherein the modular conduit has a similar cross-sectional shape as a cross-sectional shape of the functional wall module as defined by the one or more panels thereof.

5. The functional wall module as recited in claim 1, wherein the modular conduit system further comprises a register operatively associated therewith.

6. The functional wall module as recited in claim 5, wherein the modular conduit system further comprises a front plate secured to the modular conduit, the front plate being sized and configured to conceal the register, and the front plate having one or more openings to allow air to pass therethrough from or into the modular conduit.

7. The functional wall module as recited in claim 1, wherein the one or more vertical conduit supports further being coupled to at least one of the one or more vertical supports and one or more horizontal supports.

8. The functional wall module as recited in claim 1, wherein the modular conduit system further comprises an inlet coupled thereto or integrated therewith, the inlet being sized and configured to receive fluid from or to send fluid to a fluid distribution system.

9. A modular wall installation for creating an individual space that has fluid delivery thereto and/or fluid removal therefrom, the modular wall installation comprising:

one or more wall modules selectively and detachably coupled together, the one or more wall modules forming the individual space;

wherein the one or more wall modules comprise:

at least one plain wall module having a first frame and one or more panels secured to the first frame, the first frame comprising one or more vertical supports having connecting elements;

at least one functional wall module having a frame and a modular conduit system secured to or within the frame of the functional wall module, the frame of the at least one functional module comprising one or more vertical supports having connecting elements, wherein the at least one functional wall module conveys fluid into the individual space or removes fluid from the individual space, the modular conduit system being movable vertically within the frame, allowing a register to be repositioned by a user from a first vertical position to a second different vertical position in the functional wall module, the register incorporating one or more seals that channel the flow of fluid through the register; and at least one snap-in connector detachably secures the vertical supports of the at least one plain wall module with the vertical supports of the at least one functional wall module.

10. The modular wall installation as recited in claim 9, further comprising a fluid distribution system and one or more connector conduits connecting the functional wall module to the fluid distribution system.

11. The modular wall installation as recited in claim 10, wherein the modular conduit system comprises a modular conduit having an inlet and an outlet, the inlet being connected to the fluid distribution system.

12. The modular wall installation as recited in claim 11, further comprising one or more functional devices connected at the outlet of the modular conduit.

13. The modular wall installation as recited in claim 9, wherein the at least one functional wall module further comprises one or more panels secured to the frame thereof.

14. The modular wall installation as recited in claim 9, wherein the modular conduit system includes:

one or more user-installable outlets; and one or more functional devices connected to the one or more user-installable outlets of the modular conduit.

15. The modular wall installation as recited in claim 9, wherein the at least one functional wall module conveys fluid into at least two individual spaces or removes fluid from at least two individual spaces.

16. A method of setting up a modular wall installation capable of selective configuration and reconfiguration and further capable of conveying fluid to as well as removing fluid from an individual space, the method comprising:

assembling a frame of a first functional wall module;

securing a modular conduit system to or within the frame of the first functional wall module;

securing one or more panels to the frame of the first functional wall module;

selectively coupling the first functional wall module to one or more other wall modules, thereby forming the individual space, wherein selectively coupling the first functional wall module to one or more other wall modules comprises detachably securing the frame of the first functional wall module with a frame of the one or more other wall module with at least one snap-in connector, wherein the one or more other wall modules comprise one or more of a second functional wall module and a plain wall module, the first functional wall module including a register that can be repositioned by a user from a first vertical position to a second different vertical position in the first functional wall module, the register incorporating one or more seals that channel the flow of fluid through the register.

17. The method as recited in claim 16, wherein selectively coupling the first functional wall module to one or more wall modules comprises securing a vertical support of the first functional wall module to a vertical support of the one or more wall other modules with a snap-in connector.

18. The method as recited in claim 16, wherein securing a modular conduit system to or within the frame of the first functional wall module comprises securing at least one vertical conduit support of the modular conduit system to the frame of the first functional wall module.

19. The method as recited in claim 18, wherein:

the frame of the first functional wall module comprises one or more vertical support members and one or more horizontal support members coupled to the vertical support members; and securing at least one vertical conduit support of the modular conduit system to the frame of the first functional wall module comprises securing the at least one vertical conduit support to at least one of the one or more horizontal supports.

20. The method as recited in claim 16, further comprising decoupling and removing the first functional wall module from the one or more other wall modules, and selectively coupling a third functional wall module to the one or more other wall modules, the third functional wall module being different from the first functional wall module.

* * * * *